US005975984A

United States Patent [19]

Tart

[11] Patent Number: 5,975,984

[45] Date of Patent: Nov. 2, 1999

[54] DURABLE PADDED INTERCHANGEABLE BRASSIERE STRAP SHOULDER SHIELD

[76] Inventor: Mable M. Tart, 24324 Hwy. 365 P.O. Box 43, Woodson, Ark. 72180

[21] Appl. No.: 08/878,408

[22] Filed: Jun. 18, 1997

[51] Int. Cl.[6] ..... A41D 27/26

[52] U.S. Cl. ..... 450/86; 2/268; 2/459; 2/460

[58] Field of Search ..... 2/267, 268, 1, 2/455, 459, 460, 461, 462, 46, 22, 23, 24; 450/86, 53, 54, 55, 56, 57

[56] References Cited

U.S. PATENT DOCUMENTS

| | | | |
|---|---|---|---|
| 2,505,272 | 4/1950 | Blalock et al. | 450/86 |
| 2,638,603 | 5/1953 | Riedler et al. | 2/268 |
| 3,044,075 | 7/1962 | Rawlings | 2/267 |
| 3,050,734 | 8/1962 | Dopyera | 2/268 |
| 3,229,694 | 1/1966 | Koropp | 450/86 |
| 4,612,935 | 9/1986 | Greiger | 2/268 |
| 4,795,399 | 1/1989 | Davis | 2/268 |
| 4,953,233 | 9/1990 | Moshier | 2/268 |

FOREIGN PATENT DOCUMENTS

| | | | |
|---|---|---|---|
| 0506546 | 6/1993 | European Pat. Off. | 450/86 |

*Primary Examiner*—Jeanette Chapman
*Attorney, Agent, or Firm*—Jerry L. Mahurin

[57] ABSTRACT

A Durable Padded Interchangeable Brassiere Strap Shoulder Shield is intended to be placed beneath a brassiere strap between the brassiere strap and the wearer's shoulder. Velcro® hook fastener material disposed on the dorsal surface of the shield engages the brassiere strap and holds the shield in place while the padded material absorbs the shock from the brassiere strap. The shield is comprised of a resilient semi-rigid form. The form has a gently curved shape in the general contour of a human shoulder, curving from front to back. Padding is disposed upon a bottom side of the form. The padding is held in place by a covering disposed over the padding and the form. The covering directly covers the form and is tight enough to hold the padding against the form giving the shield the general contour established by the form. The hook fastener material is disposed on the covering opposite the padding material. In the preferred embodiment the seam in the covering is disposed on dorsal surface of the shield, between the form and the hook fastener away from the wearer's shoulder. Alternatively, lace or similar material can be secured between the hook fastener portion and the covering to help conceal the shield.

17 Claims, 3 Drawing Sheets

DURABLE PADDED INTERCHANGEABLE BRASSIERE STRAP SHOULDER SHIELD

BACKGROUND OF THE INVENTION

The present invention broadly relates to brassieres. Specifically, the present invention is a Durable Padded Interchangeable Brassiere Strap Shoulder Shield. Art pertinent to the subject matter of the present invention can be found in various Subclasses of United States Patent Classes 2 and 450.

Numerous patents have been issued on padded straps for brassiere and pads intended to be used in conjunction with a brassiere strap. Smith, U.S. Pat. No. 5,507,681, discloses construction of a cushioned brassiere strap. Greenberg, U.S. Pat. No. 4,795,400 is a laminated padded brassiere strap. Davis. U.S. Pat. No. 4,795,399, discloses a brassiere shoulder strap bearing pad. It employs two pairs of resilient tabs to hold it in place on the brassiere.

Several patents employ the hook portion of a hook and pile fastener material such as Velcro® or the like to hold outer garments in place, particularly blouses. Ralli, U.S. Pat. No. 5,155,869, is a contoured shoulder pad intended to be secured to a brassiere strap using a hook and pile fastener material closure on its underside. A section of the hook portion of hook and pile fastener material disposed on top of the pad holds a blouse in place. Reaver, U.S. Pat. Nos. 4,764,988 and 4,704,745, each disclose a sleevelike member intended to fit over a brassiere strap. Reaver, U.S. Pat. No. 4,764,988, is held in place by a hook and pile fastener material closure edge. Hook and pile fastener material disposed on the top of the sleeve is used to help hold a garment in place in relation to a brassiere strap.

Two patents issued to Melton, U.S. Pat. Nos. 5,201,078, and 4,945,576 disclose the use of a hook and pile fastener material closure to hold a fold-over, combination brassiere pad and shoulder pad in place on a brassiere strap. The hook and pile fastener material on these pads envelop the brassiere strap. Jolmson, U.S. Pat. No. 4,575,874 also discloses a fold-over, hook and pile fastener material secured brassiere strap pad. Two different embodiments are disclosed, in one the hook and pile fastener material closure envelops the brassiere strap, on the other it is disposed on either side of the strap.

Hence, it is desirable to provide a durable padded interchangeable brassiere strap shoulder shield which employs only the hook portion of hook and pile fastener material to engage the strap of a brassiere to hold it in place, eliminating the need to close a flap or align a pile fastener portion. Further, such a device should hold itself in place allowing minimal slippage and conform to the shape of the wearer's shoulder thereby reliving digging-in and other painful or uncomfortable irritations by the brassiere strap.

SUMMARY OF THE INVENTION

My durable padded interchangeable brassiere strap shoulder shield uses the hook portion of hook and pile fastener material such as Velcro® to engage the strap of a brassiere. This holds the shield in place. The shield is easily placed as there is no flap to close or pile fastener to align. The hooks of the hook fastener material simply engage the brassiere strap, without the need to secure a pile fastener. The hook fastener material securely holds the shield in place, generally aligned with the strap and generally conforming to the front to rear curve of the wearer's shoulder.

My durable padded interchangeable brassiere strap shoulder shield is comprised of a resilient semi-rigid form. The form has a gently curved shape in the general contour of a human shoulder, curving from front to back. Padding is disposed upon a bottom side of the form. The padding is held in place by a relatively tight covering disposed over the padding and the form. The covering directly covers the form and is tight enough to hold the padding against the form providing the general contour established by the form. Hook fastener material for engaging the brassiere strap is disposed upon the covering opposite the padding material, adjacent a dorsal surface of the form. The seam in the covering is preferably disposed on the dorsal surface of the shield, between the form and the hook fastener material away from the wearer's shoulder. Lace or similar material can be secured between the hook fastener portion and the covering to help conceal the shield. A further alternative embodiment includes one or more tack stitches to hold the components of the shield in place. Preferably, the tack or tacks penetrate all the layers of the padded shield.

For use the shield is placed beneath a brassiere strap between the brassiere strap and the wearers shoulder. The hook fastener material engages the brassiere strap and holds the shield in place while the padded material absorbs the shock from the brassiere strap. The shield can easily be removed, for cleaning or use with another brassiere.

Therefore, a primary object of the present invention is to provide a durable padded interchangeable brassiere strap shoulder shield.

Another primary object of the present invention is to provide a durable padded interchangeable brassiere strap shoulder shield which is held in place by hook fastener material.

Particularly, an object of the present invention is to provide a brassiere strap shoulder shield which employs the hook fastener material portion of hook and pile fastener material such as Velcro® or the like to engage the brassiere strap.

An object of the present invention is to provide a brassiere strap shoulder shield which provides a buffer between the wearer's shoulder and a brassiere strap preventing "digging in".

An object of the present invention is to provide a durable padded interchangeable brassiere strap shoulder shield which provides bearing support for a brassiere strap, more widely distributing the weight supported by the brassiere strap.

An object of the present invention is to provide a durable padded interchangeable brassiere strap shoulder shield which aids in supporting the weight of the wearer's breasts to decrease associated discomfort from the brassiere strap.

A related object of the present invention is to provide a durable padded interchangeable brassiere strap shoulder shield which absorbs movement of a brassiere strap reducing irritation to the users shoulder.

Another object of the present invention is to provide a durable padded interchangeable brassiere strap shoulder shield which conforms to the wearers body to increase comfort.

A related object of the present invention is to provide a durable padded interchangeable brassiere strap shoulder shield which conforms to the wearers shoulder to decrease slippage of the shield.

Another object of my brassiere strap shoulder shield is to be readily interchangeable between brassieres.

A related object of the present invention is to provide a durable padded interchangeable brassiere strap shoulder shield which can be used on either shoulder of a wearer.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
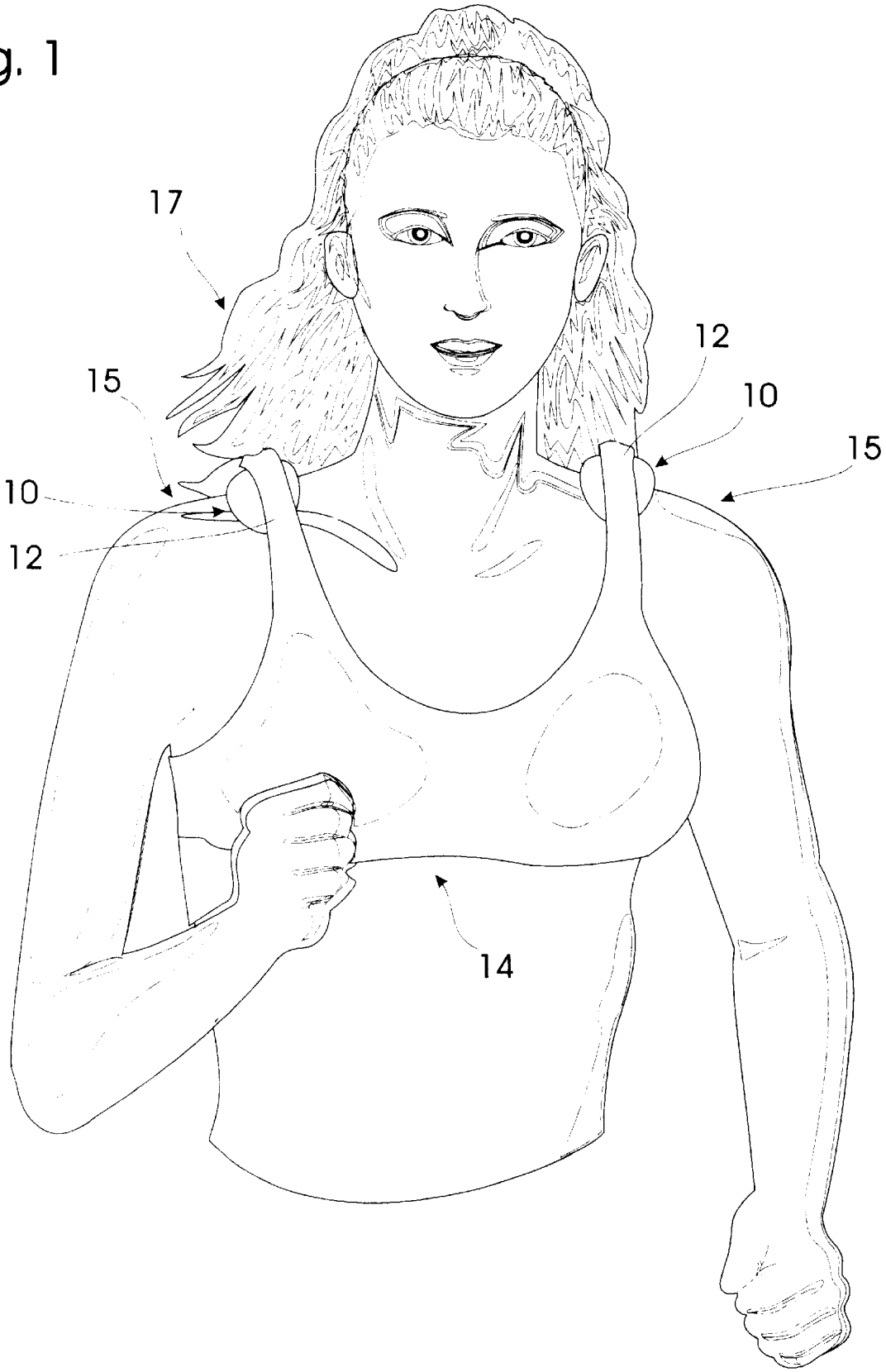
FIG. 1 is an environmental perspective view of a my durable padded interchangeable brassiere strap shoulder shield in use, deployed between a brassiere strap and the wearer's shoulder.
Figure 2:
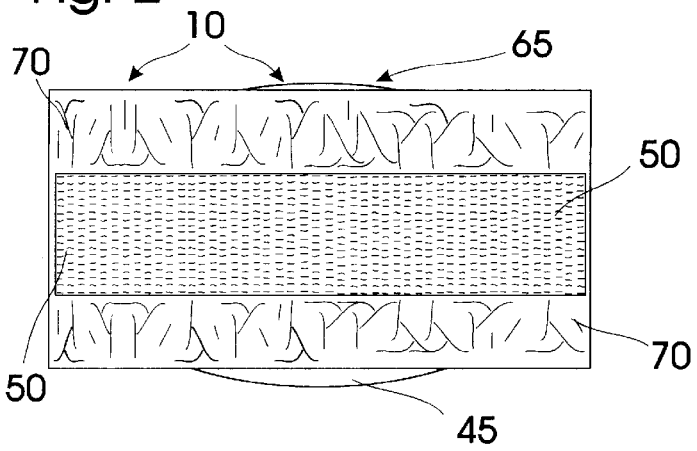
FIG. 2 is a top plan view of the preferred embodiment of my shield.
Figure 3:
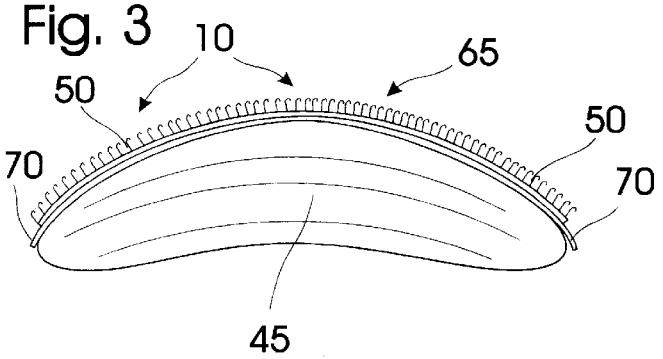
FIG. 3 is a side view of my shield.
Figure 4:
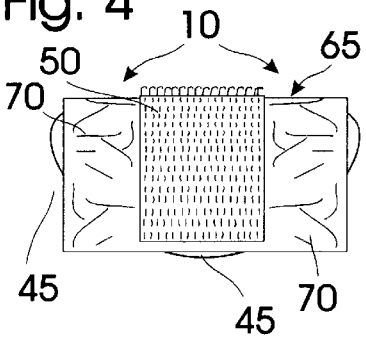
FIG. 4 is an end view of my shield taken generally from the right of FIG. 3.
Figure 5:
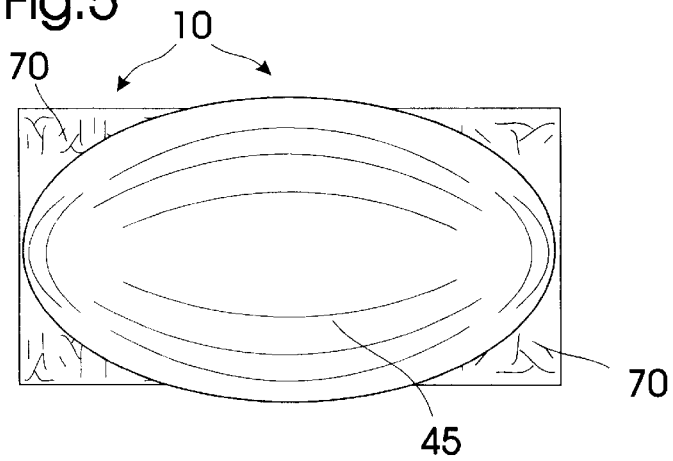
FIG. 5 is a bottom view of my shield.

With reference now to the accompanying drawings, the preferred embodiment of my durable padded interchangeable brassiere strap shoulder shield is broadly designated by the reference numeral 10. The shield 10 is interchangeably placed beneath the strap 12 of a brassiere 14 between the brassiere strap 12 and the shoulder 15 of the wearer 17.

My durable padded interchangeable brassiere strap shoulder shield 10 is comprised of a resilient semi-rigid form 20 which provides shape to padding 35 and a covering 45. The form 20 has a gently curved shape in the general contour of a human shoulder 15, curving from end 30 to end 30 and relatively flat from side 32 to side 32. The padding 35 is disposed upon a ventral surface 40 of the form 20. The padding 35 is held in place by a tight covering 45 disposed over the padding 35 and the form 20. The covering 45 directly covers the form 20 and padding 35. The covering is tight enough to hold the padding 35 against the ventral surface 40 of the form 20 providing the entire shield 10 with the general contour established by the form 20.

Hook fastener material 50 for engaging the brassiere strap 12 and holding the shield 10 in place is disposed on the covering 45, opposite the padding 35 material, adjacent the dorsal surface 55 of the form 20. In short, the hook fastener material 50 is disposed on the top of the shield 10.

Preferably, the seam 60 closing the covering 45 is disposed on the top 65 of the shield 10, away from the wearer's shoulder 15. In other words, the seam 60 is disposed adjacent the dorsal surface 55 of the form, between the form 20 and the hook fastener material 50.

Figure 6:
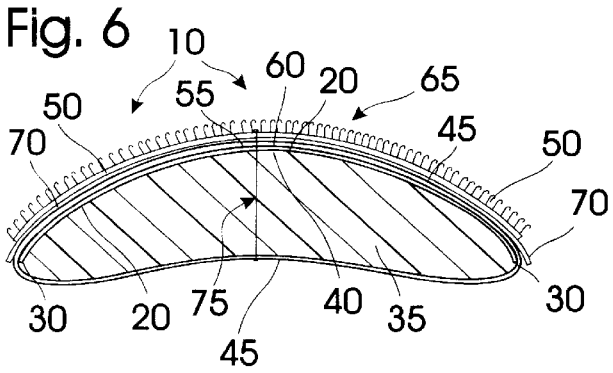
FIG. 6 is a fragmented side view of an embodiment of my durable padded interchangeable brassiere strap shoulder shield employing tacks to hold the elements of the shield in place relative to one another.
Figure 7:
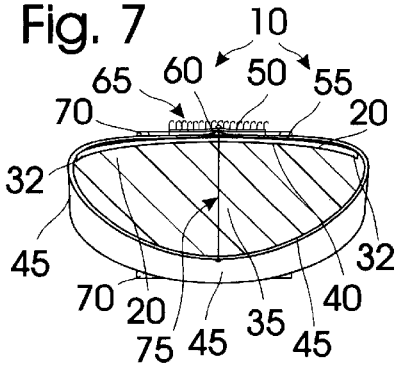
FIG. 7 is a fragmented end view of my shoulder shield.
Figure 8:
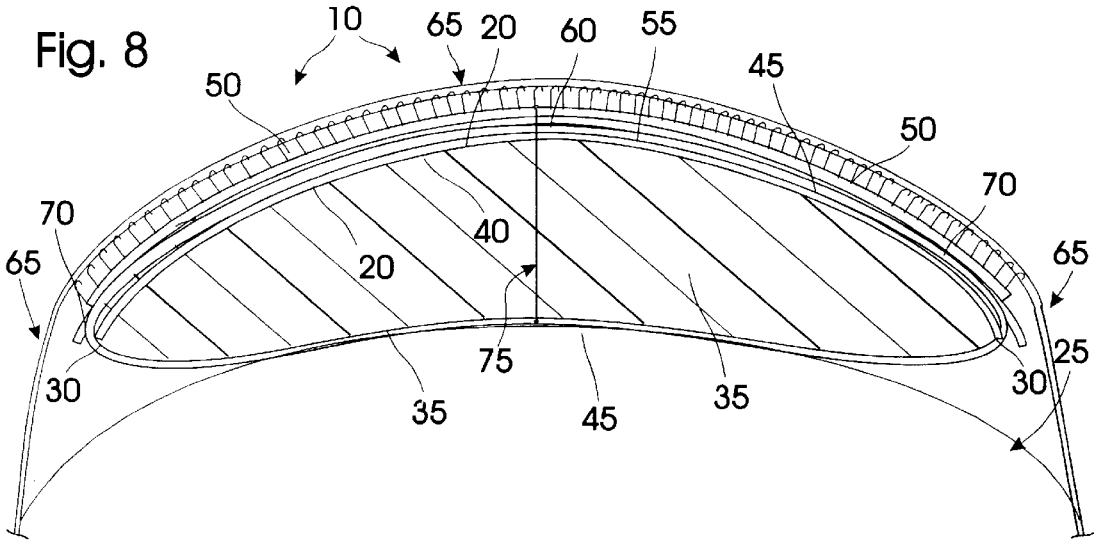
FIG. 8 is an enlarged, fragmented side view of a preferred embodiment of my durable padded interchangeable brassiere strap shoulder shield deployed between the shoulder of a wearer and a brassiere strap with the shoulder of the wearer shown in outline only, for clarity.
Figure 9:
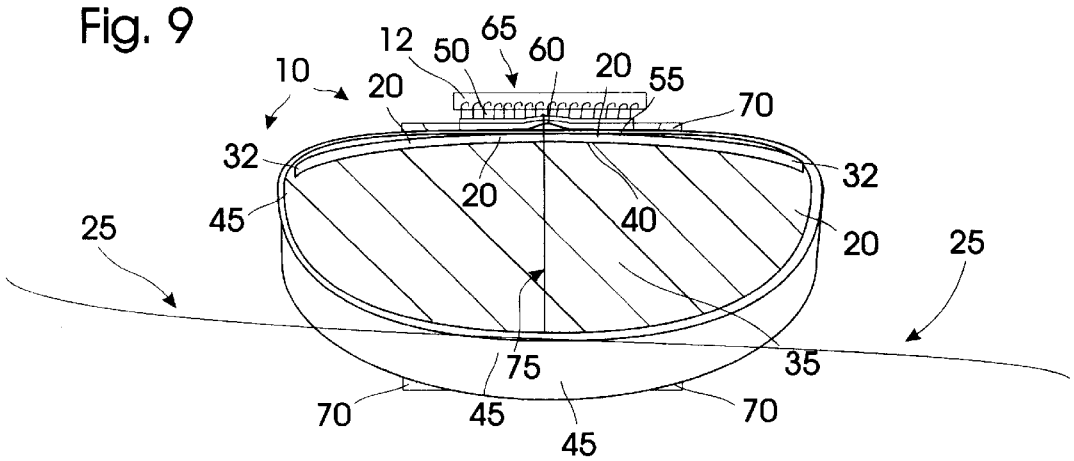
FIG. 9 is an enlarged, fragmented end view of a preferred embodiment of my shield deployed between the shoulder of a wearer and a brassiere strap with the shoulder of the wearer shown in outline only, for clarity.

To aid in concealing the presence of the shield, lace 70 or similar material may be secured between the hook fastener material 50 and the covering 45. Alternatively, the covering 45 itself can be made of lace or a lace like material. An additional alternative element is one or more tack stitches 75 used to help maintain the form 20, padding 35, covering 45, hook fastener material 50 and lace 70 in proper relationship. See FIG. 6. The tack or tacks 75 extend through each of the elements, form 20, padding 35, covering 45, hook fastener material 50 and lace 70. Each tack 75 can be a single blind stitch tied at each end or preferably a looped stitch tied off on the top 65 of the shield 10, disposed within the hooks of the hook fastener material 50.

In use, a shield 10 is interchangeably placed beneath either brassiere strap 12, between the brassiere strap 12 and the wearer's shoulder 15. The hook fastener material 50 engages the brassiere strap 12 and holds the shield 10 in place while the padding material 35 absorbs shock from the brassiere strap 12. Furthermore, the shield 10 acts as a bearing pad for the strap 12. The shield 10 distributes the weight held by the strap 12 over a wider area than the strap 12 alone does.

The shield 10 is easily removed for use with another brassiere 14. When installing the shield 10, the user need not be concerned with aligning a closure of pile fastener material nor with which shield 10 is right or left. The hook fastener material 50, alone, engages the brassiere strap 12 and holds the shield 10 in place; and, the shields 10 are interchangeable, side to side.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense. For example, the use of various types of plastics or other resilient material in the form 20 is anticipated.

What is claimed is:

1. A durable padded interchangeable brassiere strap shoulder shield adapted to be disposed between a shoulder strap of a brassiere and the shoulder of a wearer to protect the wearer's shoulder from forces exerted by the brassiere strap, said shield comprising:

form means for conforming said shield to a shoulder of a wearer;

padding means for absorbing and distributing pressure and shock imparted by a brassiere strap on a shoulder of said wearer;

cover means for holding said padding means in contact with a ventral surface of said form means, said cover means disposed over said padding means and said form means;

hook pile fastener means for selectively engaging a brassiere strap to hold said shield in place between said brassiere strap and a shoulder of a person wearing said brassiere, said hook pile fastener means affixed to said covering means over a dorsal surface of said form means; and, concealment means for camouflaging said shield.

2. The shield as defined in claim 1 wherein said padding means has an ovoid shape.

3. The shield as defined in claim 2 further comprising at least one tack stitch extending through:

said hook pile fastener means;

said covering means disposed over a dorsal surface of said form means;

said form means;

said padding means; and, said covering means disposed over a ventral portion of said padding means.

4. The shield as defined in claim 3 wherein said tack stitch comprises at least one loop of thread passing through:

said hook pile fastener means;

said covering means disposed over a dorsal surface of said form means;

said form means;

said padding means; and said covering means disposed over a ventral portion of said padding means; back through:

said covering means disposed over said ventral portion of said padding means said padding means said form means said covering means disposed over said dorsal surface of said form means; and, said hook pile fastener means, closing said loop.

5. The shield as defined in claim 4 further comprising two spaced apart tack stitches.

6. The shield as defined in claim 1 wherein said concealment means comprises a layer of concealment material disposed between said hook pile fastener means and said covering means disposed over said form dorsal surface of said form means.

7. A durable padded interchangeable brassiere strap shoulder shield adapted to be disposed between a shoulder strap of a brassiere and the shoulder of a wearer to protect the wearers shoulder from forces exerted by the brassiere strap, said shield comprising:

a resilient form member, said form member comprising a dorsal surface, a ventral surface and spaced apart ends, said form member gently curving between said ends to generally conform to the contour of a human shoulder;

padding disposed against said ventral surface of said form member conforming to said curving of said form member;

a covering disposed over said padding and said form member, holding said padding in contact with said ventral surface of said form member;

hook pile fastener material affixed to said covering over said dorsal surface of said form member, said hook pile fastener material selectively engaging a brassiere strap to removeably hold said shield in place between said brassiere strap and a shoulder of a person wearing said brassiere; and, concealment material disposed between said hook pile fastener material and said dorsal surface of said form member.

8. The shield as defined in claim 7 wherein said form and said padding define generally aligned ovoid shapes.

9. The shield as defined in claim 8 further comprising at least one tack stitch extending through:

said hook pile fastener material;

said covering disposed over said dorsal surface of said form member;

said form member;

said padding; and, said covering disposed over a ventral portion of said padding.

10. The shield as defined in claim 7 wherein said tack stitch comprises at least one loop of thread passing through:

said hook pile fastener material said covering disposed over said dorsal surface of said form member;

said form member;

said padding; and, through a said covering disposed over a ventral portion of said padding; and, back through:

said covering disposed over said ventral portion of said padding;

said padding;

said form member;

said covering disposed over said dorsal surface of said form member; and, said hook pile fastener material, closing said loop.

11. The shield as defined in claim 10 further comprising two spaced apart tack stitches.

12. The shield as defined in claim 11 wherein said concealment material comprises lace.

13. A generally ovoid durable padded interchangeable brassiere strap shoulder shield adapted to be disposed between a shoulder strap of a brassiere and the shoulder of a wearer to protect the wearers shoulder form forces exerted by the brassiere strap, said shield comprising:

a generally ovoid, relatively thin semi rigid resilient form member, said form member comprising a dorsal surface, a ventral surface and spaced apart ends, said form member gently curving between said ends to generally conform to the contour of s human female shoulder;

padding disposed against said ventral surface of said form member conforming to said curving of said form member, said padding having a generally ovoid shape and said padding disposed generally aligned with said form member;

a covering disposed over said padding and said form member, holding said padding in contact with said ventral surface of said form member;

hook pile fastener material affixed to said covering over said dorsal surface of said form member, said hook pile fastener material selectively engaging a brassiere strap to removeably hold said shield in place between said brassiere strap and a shoulder of a person wearing said brassiere; and, a layer of concealment material disposed between said hook pile fastener material and said covering disposed over said form dorsal surface of said form member.

14. The shield as defined in claim 12 further comprising at least one tack stitch extending through:

said hook pile fastener material;

said covering and concealment material disposed over said dorsal surface of said form member;

said form member;

said padding; and, said covering disposed over a ventral portion of said padding.

15. The shield as defined in claim 14 wherein said tack stitch comprises at least one loop of thread passing through:

said hook pile fastener material said covering and concealment material disposed over said dorsal surface;

said form member;

said padding; and, through a said covering disposed over a ventral portion of said padding; and, back through:

said covering disposed over said ventral portion of said padding;

said padding;

said form member;

said covering and concealment material disposed over said dorsal surface; and, said hook pile fastener material, closing said loop.

16. The shield as defined in claim 15 further comprising two spaced apart tack stitches.

17. The shield as defined in claim 16 wherein said concealment material comprises lace.

* * * * *